US007756438B2

(12) United States Patent
Chae et al.

(10) Patent No.: US 7,756,438 B2
(45) Date of Patent: Jul. 13, 2010

(54) DEVICE FOR FUSING TONER ON PRINT MEDIUM

(75) Inventors: Young-min Chae, Suwon-si (KR); Sang-yong Han, Suwon-si (KR); Joong-gi Kwon, Gunpo-si (KR); Hwan-guem Kim, Seoul (KR); Durk-hyun Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 572 days.

(21) Appl. No.: 11/167,880

(22) Filed: Jun. 28, 2005

(65) Prior Publication Data

US 2005/0286926 A1 Dec. 29, 2005

Related U.S. Application Data

(60) Provisional application No. 60/583,423, filed on Jun. 29, 2004.

(30) Foreign Application Priority Data

Aug. 17, 2004 (KR) ..... 10-2004-0064588

(51) Int. Cl.
*G03G 15/00* (2006.01)

(52) U.S. Cl. ..... 399/88; 399/335; 399/70

(58) Field of Classification Search ..... 399/70, 399/122, 320, 335, 88
See application file for complete search history.

(56) References Cited

U.S. PATENT DOCUMENTS

| | | | | |
|---|---|---|---|---|
| 5,666,627 | A | 9/1997 | Yamaguchi | |
| 6,069,346 | A * | 5/2000 | Hyllberg | |
| 6,728,498 | B2 * | 4/2004 | Takeuchi | |
| 6,847,019 | B2 * | 1/2005 | Yokozeki et al. | 219/619 |
| 2002/0125244 | A1 * | 9/2002 | Yokozeki et al. | 219/619 |
| 2004/0101335 | A1 * | 5/2004 | Cho et al. | 399/330 |
| 2004/0120741 | A1 * | 6/2004 | Kim et al. | 399/330 |

FOREIGN PATENT DOCUMENTS

| | | | |
|---|---|---|---|
| CN | 1367410 | A | 9/2002 |
| EP | 1 432 290 | A2 | 6/2004 |
| JP | 55-037686 | | 3/1980 |
| JP | 57-202576 | | 12/1982 |
| JP | 04304170 | A * | 10/1992 |
| JP | 11-191483 | | 7/1999 |
| JP | 2002-334774 | | 11/2002 |
| JP | 2003-317925 | | 11/2003 |
| KR | 10-2004-0010864 | A | 2/2004 |

* cited by examiner

*Primary Examiner*—David M Gray
*Assistant Examiner*—Laura K Roth
(74) *Attorney, Agent, or Firm*—Roylance, Abrams, Berdo & Goodman, LLP

(57) ABSTRACT

A device for fusing a predetermined toner image on a paper and which electrically insulates a heating body of a fusing unit from a power supply unit by heating the heating body using an induced current generated by a transformer. The fusing device includes an insulation unit for generating an induced current in response to an alternating current, a heating body heated by the generated induced current, a toner fusing unit which fuses the toner image on the paper using the heat received from the heating body, and a tube-expansion adhesion portion closely adhering the heating body to the toner fusing unit using a predetermined tube-expansion pressure.

40 Claims, 8 Drawing Sheets

FIG. 9

| CLASSIFICATION | FIRST INSULATING LAYER (MICA) | SECOND INSULATING LAYER (MICA) | WITHSTAND VOLTAGE (AC)(kV) | WARM-UP TIME (TIME TAKEN FOR HEATING FROM 20℃ TO 180℃)(sec) |
|---|---|---|---|---|
| HALOGEN LAMP | - | - | 6 | 75 |
| E-COIL FUSING ROLLER | 0.18 mm x 3 SHEETS | 0.18 mm x 3 SHEETS | 6 | 34 |
| | 0.18 mm x 2 SHEETS | | 4.2 | 24 |
| | 0.15 mm x 3 SHEETS | | 4.8 | 27 |
| | 0.15 mm x 2 SHEETS | | 3 | 14 |
| | 0.1 mm x 3 SHEETS | | 3.3 | 16 |
| | 0.1 mm x 2 SHEETS | | 2.3 | 10 |
| | 0.1 mm x 1 SHEET | | 1.4 | 6 |

DEVICE FOR FUSING TONER ON PRINT MEDIUM

CROSS-REFERENCE TO RELATED APPLICATIONS

This application claims the benefit under 35 U.S.C.§119 of U.S. Provisional Application No. 60/583,423, filed in the U.S. Patent and Trademark Office on Jun. 29, 2004, and Korean Patent Application No. 10-2004-0064588, filed in the Korean Intellectual Property Office on Aug. 17, 2004, the entire disclosures of which are incorporated herein by reference.

BACKGROUND OF THE INVENTION

1. Field of the Invention

The present invention relates to a device for fusing a predetermined toner image on paper. More particularly, the present invention relates to a fusing device in which a heating body of a fusing unit is electrically insulated from a power supply unit, and wherein the heating body is heated using an induced current generated by a transformer.

2. Description of the Related Art

A conventional image printing apparatus comprises a fusing device which applies a predetermined pressure and heat amount to a toner so as to fuse a predetermined toner image on a paper. The fusing device includes a fusing unit which applies a predetermined amount of heat to the toner, and a pressurizer which applies a predetermined pressure to the toner. The fusing unit further includes a heating body which generates heat used to fuse a toner image on the paper, and a fusing roller which transfers the heat generated by the heating body onto the paper.

FIG. 1 is a schematic cross-sectional view taken along a lateral plane through a conventional fusing unit 10 of a fusing device using a halogen lamp as a heat source. Referring to FIG. 1, the fusing unit 10 comprises a fusing roller 11 and a heating body 12, which is comprised of a halogen lamp, installed in the center of the fusing unit 10. A coating layer 11*a* made of Teflon is formed on the surface of the fusing roller 11. The heating body 12 generates heat, and the fusing roller 11 is heated by radiant heat transferred from the heating body 12.

In a conventional fusing unit using a halogen lamp as a heat source, a warm-up time is required to reach a target fusing temperature after electrical energy is supplied to the fusing unit. This warm-up time can range from several seconds to several minutes. Thus, a user is required to wait for the completion of such lengthy warm-up times when printing an image.

In the conventional fusing unit using the halogen lamp as the heat source, in order to reduce the warm-up time, the temperature of the fusing roller is maintained above room temperature for a predetermined amount of time, even when a printing operation is not performed. Thus, unnecessary power consumption occurs.

Accordingly, a need exists for a system and method for quickly and efficiently providing heat for a fusing unit operation.

SUMMARY OF THE INVENTION

The present invention substantially solves the above and other problems, and provides a device for heating a heating body through an eddy current generated by an insulation unit so as to fuse a toner image on paper.

The present invention also provides a power supply device for supplying an eddy current generated by an insulation unit to a fusing unit.

The present invention also provides a fusing unit having a thin insulating layer for electrically insulating a power supply unit and a heating body from each other.

The present invention also provides a fusing device for warming-up a fusing unit within a short time.

According to an aspect of the present invention, a heating device is provided for a fusing unit for fusing a toner image on a paper, the heating device comprising a power supply unit for supplying a predetermined alternating current, an insulation unit for generating an induced current in response to the alternating current, and a heating body being resistance-heated by the induced current.

The insulation unit may be comprised of a transformer which generates an induced current in response to the alternating current.

According to another aspect of the present invention, a power supply device is provided for supplying power to a fusing unit for fusing a toner image on a paper, the power supply device comprising a power supply unit for supplying a predetermined alternating current, and an insulation unit for generating an induced current in response to the alternating current and supplying the generated induced current to the fusing unit.

The insulation unit may be comprised of a transformer which generates an induced current in response to the alternating current.

The device may further comprise a rectifier for generating a direct current by rectifying the alternating current, and an alternating-current generator for generating an alternating current from the direct current and supplying the generated alternating current to the insulation unit.

According to another aspect of the present invention, a unit is provided for fusing a toner image on a paper, the unit comprising a heater to which a predetermined induced current is applied which resistance-heats the heater, and a toner fusing unit which fuses the toner image on the paper using the heat received from the heater.

The unit may further comprise an insulating layer which electrically insulates the heating body from the toner fusing unit, wherein a withstand voltage of the first insulating layer may be equal to or less than 1 kV.

According to another aspect of the present invention, a device is provided for fusing a toner image on a paper, the device comprising a power supply unit to which a predetermined alternating current is input and which generates a first induced current in response to the input alternating current, and a fusing unit being resistance-heated and induction-heated by the first induced current and fusing the toner image on the paper using the generated heat.

The fusing unit may comprise a heating body which is resistance-heated by the first induced current and a toner fusing unit which fuses the toner image on the paper using the heat received from the heating body, wherein a withstand voltage of the insulating layer may be equal to or less than 1 kV.

The heating body may further generate a second induced current in the toner fusing unit by the first induced current, wherein the toner fusing unit is heated by the resistance-heating of the heating body due to the first induced current and the induction-heating of the toner fusing unit due to the second induced current.

BRIEF DESCRIPTION OF THE DRAWINGS

The above and other features and advantages of the present invention will become more apparent by describing in detail exemplary embodiments thereof with reference to the attached drawings, in which:

FIG. 9 is a table illustrating experimental data comparing warm-up times of a fusing unit using a halogen lamp as a heat source, and a fusing unit in which a fusing roller and heaters are closely adhered to one another according to an embodiment of the present invention.

Throughout the drawings, like reference numerals will be understood to refer to like parts, components and structures.

DETAILED DESCRIPTION OF THE EXEMPLARY EMBODIMENTS

Figure 1:
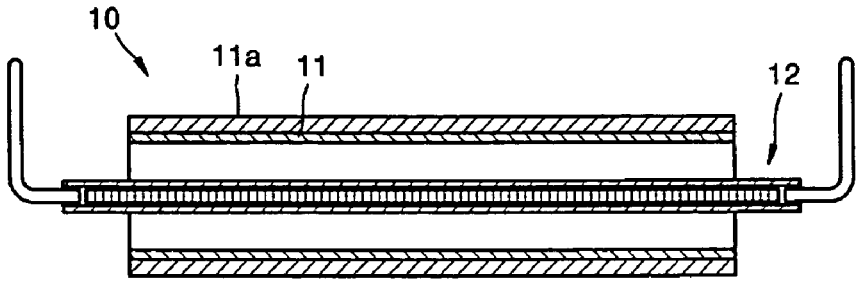
FIG. 1 (PRIOR ART)
FIG. 1 is a cross-sectional view taken along a lateral plane through a conventional fusing unit of a fusing device using a halogen lamp as a heat source.
Figure 2:
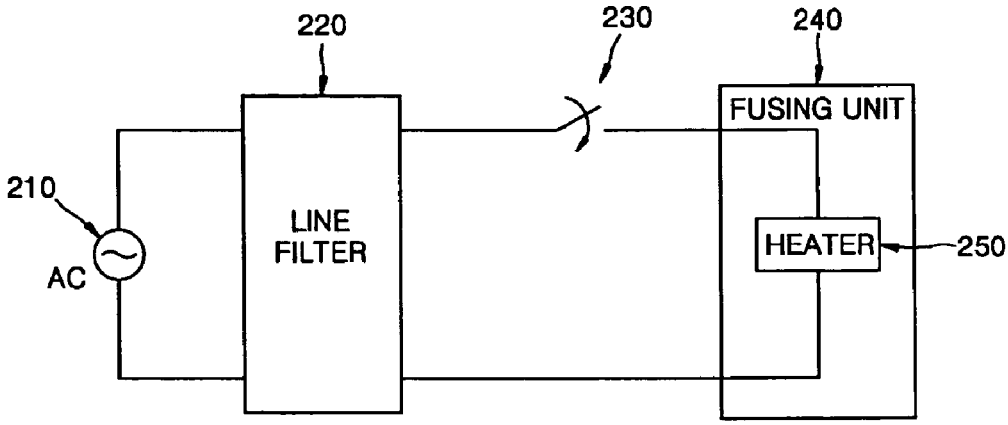
FIG. 2 is a functional block diagram of a fusing device for heating a fusing unit.

FIG. 2 is a functional block diagram of a fusing device for heating a fusing roller. Referring to FIG. 2, the fusing device comprises a power supply unit 210, a line filter 220, a conductive switch 230, and a fusing unit 240. The power supply unit 210 supplies an alternating current (AC), and the line filter 220 removes harmonics that cause noise in the AC. The conductive switch 230 supplies or cuts off a current, from which harmonics have been removed by the line filter 220, to the fusing unit 240. The fusing unit 240 includes a heater 250 and a fusing roller (not shown). The heater 250 includes a heating coil (not shown) and an insulating layer (not shown) for insulating the fusing roller from the heating coil. The fusing unit 240 will be described in greater detail below with reference to FIGS. 3A and 3B. The heating coil is resistance-heated by the AC supplied by the line filter 220. Heat generated by the heating coil is transferred to the fusing roller via the insulating layer, and when paper passes the fusing roller, the fusing roller melts the toner and fuses a toner image on the paper.

Figure 3A:
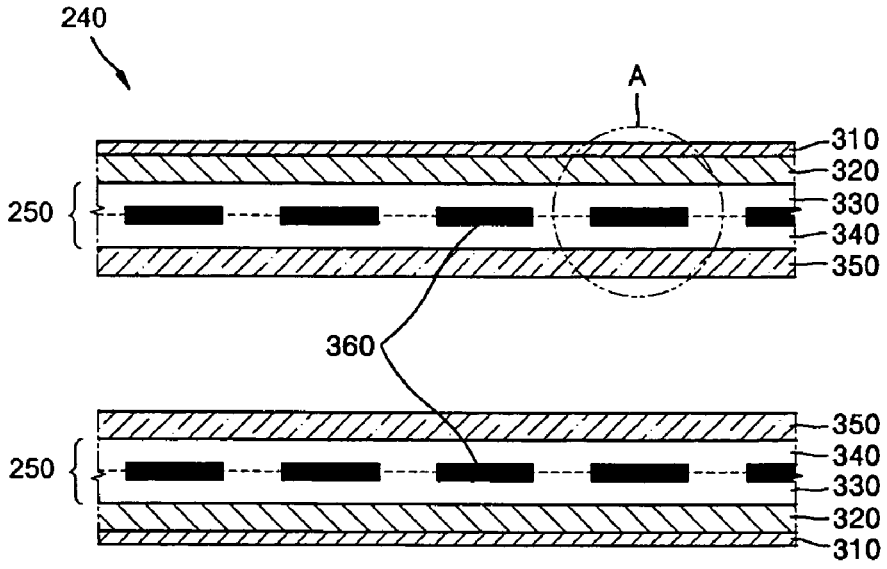
FIG. 3A is a cross-sectional view taken along a lateral plane through the fusing unit of FIG. 2.
Figure 3B:
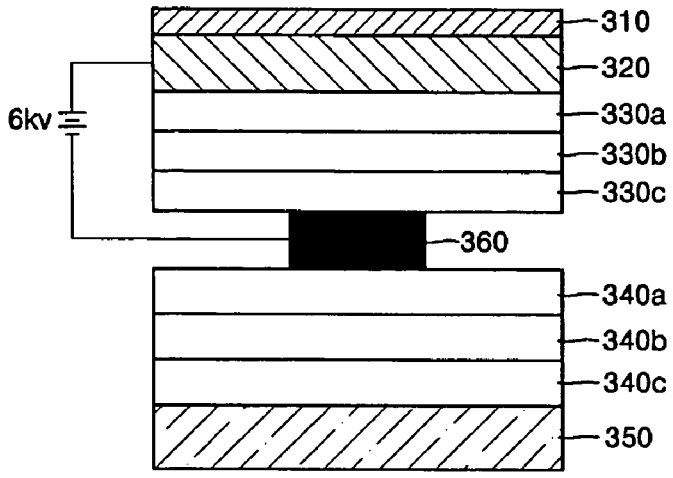
FIG. 3B is a detailed diagram of a heater of the fusing unit of FIG. 3A.

FIG. 3A is a cross-sectional view taken along a lateral plane through the fusing unit 240 in which the heater 250 is closely adhered to the fusing roller, and FIG. 3B is a detailed diagram of the heater 250 of the fusing unit 240 shown in FIG. 3A. Referring to FIGS. 3A and 3B, the fusing unit 240 comprises a fusing roller 320 on which a protective layer 310 having a surface coated with Teflon is formed, a tube-expansion adhesion portion 350 having a tubular shape with open ends disposed inside the toner fusing unit 320, and the heater 250 installed between the fusing roller 320 and the tube-expansion adhesion portion 350. The heater 250 comprises a heating coil 360 which is disposed on the tube-expansion adhesion portion 350 in a helical shape and generates heat from a current input from an external power supply unit, and insulating layers 330 and 340 that surround the heating coil 360 and insulate the tube-expansion adhesion portion 350 and the fusing roller 320 from the heating coil 360 so that dielectric breakdown does not occur and a leakage current does not flow when a current is input to the heating coil 360.

The fusing roller 320 is heated by heat transferred from the heating coil 360 and fuses the toner image on the paper (not shown). The fusing roller 320 may be comprised of stainless steel, aluminum (Al), or copper (Cu) materials.

The insulating layers include a first insulating layer 330 interposed between the fusing roller 320 and the heating coil 360, and a second insulating layer 340 interposed between the heating coil 360 and the tube-expansion adhesion portion 350.

The first and second insulating layers 330 and 340 may be comprised of MgO sheets or glass sheets. Heat generated by the heating coil 360 passes through the first insulating layer 330 and the second insulating layer 340 to the fusing roller 320 and the tube-expansion adhesion portion 350, respectively.

The insulating layers 330 and 340 should preferably have withstand voltage and resistance to dielectric breakdown characteristics as required by manufacturing standards and other standards recognized by each of a number of countries in which the device is used. The withstand voltage characteristics are characteristics of a product or material reflecting that the product or material can withstand a predetermined external voltage applied, and the resistance to dielectric breakdown characteristics are characteristics reflecting that the product or material does not generate leakage currents of 10 mA or greater and dielectric breakdown does not occur within a maximum withstand voltage for one minute. Safety standard requirements of different countries require different withstand voltages between the fusing roller 320 and the heating coil 360. In order to satisfy the required withstand voltages, the first insulating layer 330 and the second insulating layer 340 are preferably inserted between the fusing roller 320 and the tube-expansion adhesion portion 350.

FIG. 3B is a more detailed diagram of portion A shown in FIG. 3A, that is, the heater 250 of the fusing unit 240. When the required withstand voltage between the fusing roller 320 and the heating coil 360 is 6 kV, the first insulating layer 330 should preferably include three mica sheets 330*a*, 330*b*, and 330*c*, each having a thickness of about 0.18 mm. However, as the thickness of the insulating layers inserted between the fusing roller 320 and the heating coil 360 is increased, the amount of heat transferred to the fusing roller 320 decreases. In a similar manner, the second insulating layer 340 can include three sheets 340*a*, 340*b*, and 340*c*.

Figure 4:
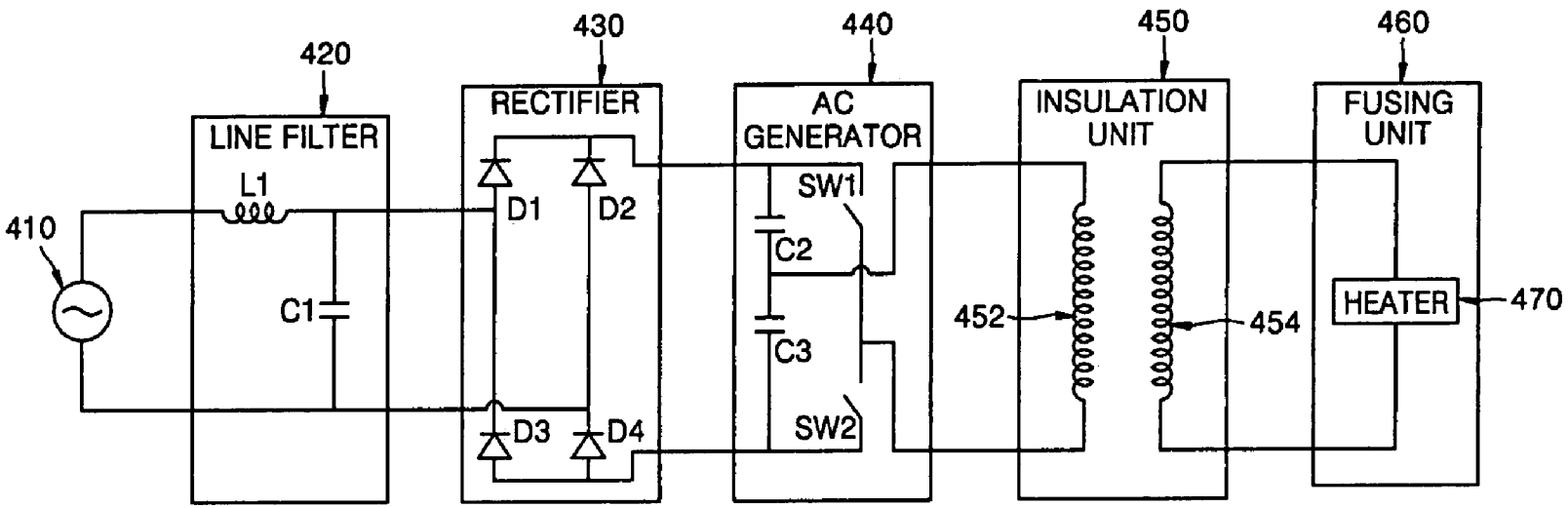
FIG. 4 is a functional block diagram of a fusing device according to an embodiment of the present invention.

FIG. 4 is a functional block diagram of a fusing device according to an embodiment of the present invention. The fusing device of FIG. 4 comprises a power supply unit 410, a line filter 420, a rectifier 430, an AC signal generator 440, an insulation unit 450, and a fusing unit 460 having a heater 470. The fusing unit 460 of FIG. 4 will be described in greater detail below with reference to FIGS. 6A and 6B. The power supply unit 410 supplies an AC signal having a predetermined amplitude and frequency. The line filter 420 includes an inductor L1 and a capacitor C1, and removes harmonic components included in the AC signal input from the power supply unit 410. The line filter 420 is illustrated as one type of a line filter (an LC filter), for illustration purposes in an exemplary embodiment of the present invention. Another type of line filter may be used as the line filter 420 without departing from the scope of the present invention.

The rectifier 430 generates a DC signal by rectifying the AC signal supplied by the line filter 420. The rectifier 430 is a bridge rectifier comprising four diodes D1, D2, D3, and D4, and rectifies the AC signal into the DC signal according to the polarities of the four diodes D1, D2, D3, and D4. Another type of line rectifier may be used as the rectifier 430 without departing from the scope of the present invention.

The AC generator 440 generates an AC signal from the DC signal supplied by the rectifier 430. The AC generator 440 comprises two capacitors C2 and C3, and two switches SW1 and SW2, and converts the DC signal rectified by the rectifier 430 into an AC signal by switching the switches SW1 and SW2 on and off. The AC generator 440 generates a high-frequency or low-frequency AC signal by receiving the DC signal generated by the rectifier 430 according to an application of the fusing device. Another type of AC generator may be used as the AC generator 440 without departing from the scope of the present invention.

The insulation unit 450 generates an induced current using the AC signal generated by the AC generator 440, and supplies the generated induced current to the heater 470. The heater 470 comprises a heating body (not shown), which is resistance-heated by the induced current, and a thin insulating layer (not shown) for preventing the heating body and a toner fusing unit (not shown) of the fusing unit 460 from being shorted to each other. The current input by the power supply unit 410 is not directly supplied to the heating body, but the induced current generated using the insulation unit 450 is supplied to the heating body such that the insulation unit 450 electrically insulates the power supply unit 410 from the heating body of the fusing unit 460. Hereinafter, a high-frequency transformer will be described as an example of the insulation unit 450, wherein the high-frequency transformer has a smaller volume than a low-frequency transformer.

When an AC signal flows through a primary coil 452 of the transformer 450, a magnetic field around a secondary coil 454 changes, and an induced current is generated in the secondary coil 454 by the changing magnetic field. Hereinafter, the induced current generated by the transformer 450 will be referred to as a first induced current. The first induced current generated by the transformer 450 is supplied to the heater 470. The size of the first induced current can be controlled by a winding ratio of the primary coil 452 and the secondary coil 454. A current from the power supply unit 410 that flows through the primary coil 452 of the transformer 450 causes an induced current in the secondary coil 454 of the transformer 450 by electromagnetic induction. Since the first induced current generated by the transformer 450 is supplied to the secondary coil 454 instead of the current of the power supply unit 410, the power supply unit 410 and a heating body (not shown) of the heater 470 are electrically insulated from each other.

Figure 5:
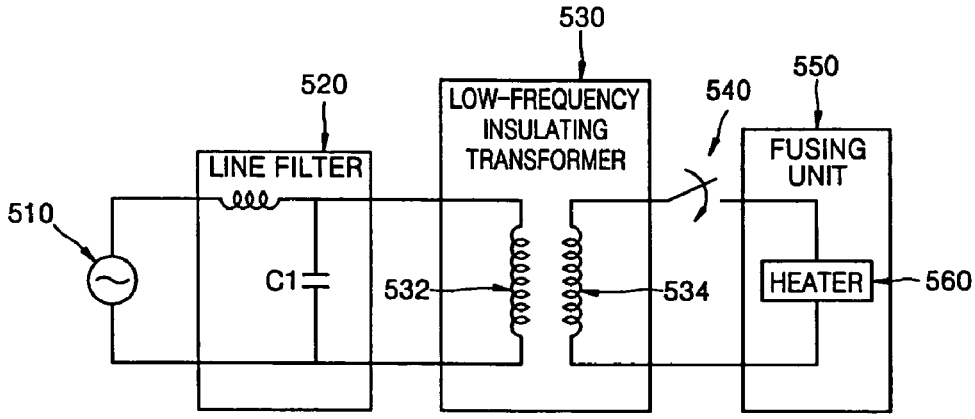
FIG. 5 is a functional block diagram of a fusing device according to another embodiment of the present invention.

FIG. 5 is a functional block diagram of a fusing device according to another embodiment of the present invention. The fusing device of FIG. 5 comprises a power supply unit 510, a line filter 520, a transformer 530, a conductive switch 540, and a fusing unit 550 having a heater 560. The power supply unit 510, the line filter 520, and the fusing unit 550, are substantially the same as the power supply unit 410, the line filter 420, and the fusing unit 460 shown in FIG. 4, respectively. The fusing device shown in FIG. 5, however, does not include the rectifier 430 and the AC generator 440.

The conductive switch 540 supplies or cuts off the current, from which harmonic components are removed by the line filter 520, to the fusing unit 550 by switching on and off. A current of the power supply unit 510 that flows through a primary coil 532 of the transformer 530 generates a first induced current in a secondary coil 534 of the transformer 530 by electromagnetic induction. The first induced current is supplied to the heater 560 of the fusing unit 550. Since the first induced current generated by the transformer 530 is supplied to a heating body (not shown) of the heater 560 instead of the current of the power supply unit 510, the power supply unit 510 and the heating body of the heater 560 are electrically insulated from each other.

In the fusing devices of FIGS. 4 and 5, the heaters 470 and 560 of the fusing units 460 and 550 are electrically insulated from the power supply units 410 and 510 by the transformers 450 and 530, respectively. Thus, in the fusing devices of FIGS. 4 and 5, the heaters 470 and 560 of the fusing units 460 and 550, respectively, do not require the thick insulating layers 330*a*, 330*b*, and 330*c* like the fusing unit shown in FIG. 3, respectively, but require only thin insulating layers such that the heating bodies of the heaters 470 and 560 and the toner fusing units are not shorted to each other. The thin insulating layer may be comprised of an insulating layer having a withstand voltage equal to or less than 1 kV.

Figure 6A:
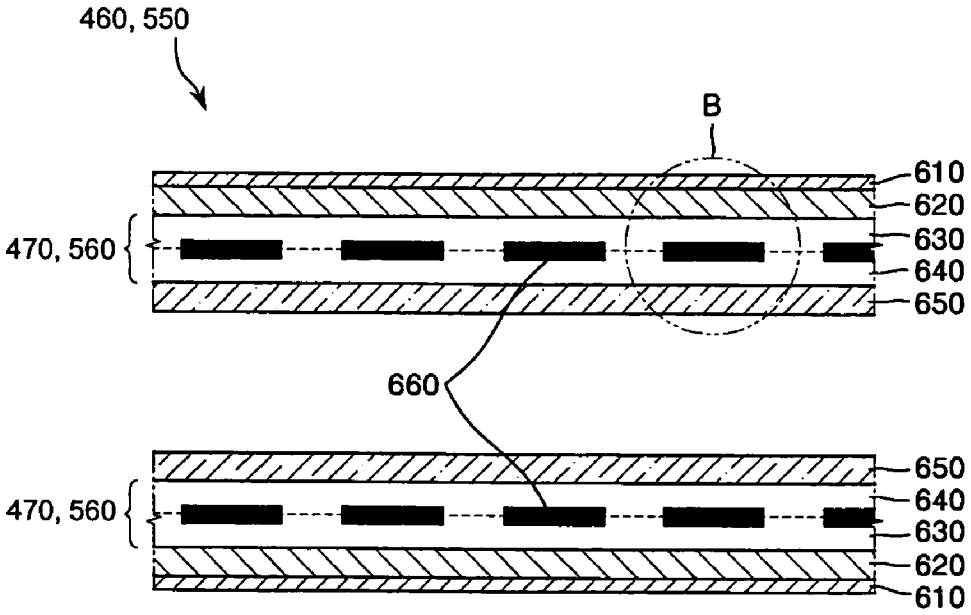
FIG. 6A is a cross-sectional view taken along a lateral plane through the fusing unit used in the fusing device of FIG. 4 or 5.
Figure 6B:
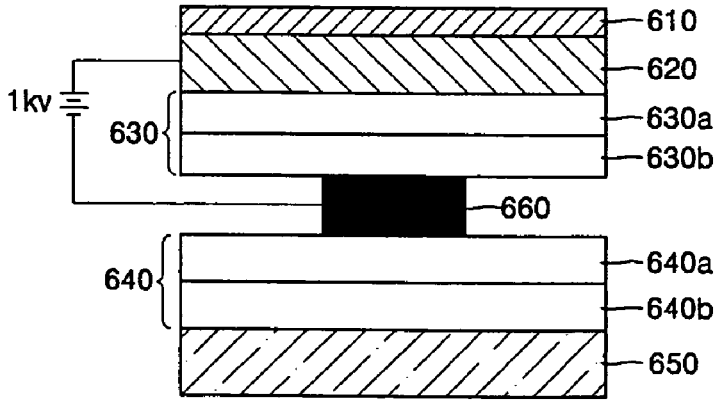
FIG. 6B is a detailed diagram of a heater of the fusing unit shown in FIG. 6A.

The fusing units 460 and 550 of FIGS. 4 and 5 will now be described in greater detail with reference to FIGS. 6A and 6B. FIG. 6A is a cross-sectional view taken along a lateral plane through the fusing unit 460 or 550 used in the fusing device of FIG. 4 or 5, and FIG. 6B is a detailed diagram of the heater 470 or 560 of the fusing unit 460 or 550 shown in FIG. 6A.

Referring to FIG. 6A, the fusing unit 460 or 550 comprises a toner fusing unit 620 having a cylindrical shape on which a protective layer 610 having a surface coated with Teflon is formed, a tube-expansion adhesion unit 650 having a tubular shape with open ends disposed inside the toner fusing unit 620, and a heater 470 or 560 interposed between the toner fusing unit 620 and the tube-expansion adhesion unit 650. The heater 470 or 560 comprises a heating body 660 surrounding the tube-expansion adhesion unit 650 in a helical shape and generating heat from a current supplied by an external power source, and insulating layers 630 and 640 surrounding and insulting the heating body 660 such that the heating body 660 is not shorted to the toner fusing unit 620 and the tube-expansion adhesion unit 650.

Although the toner fusing unit 620 of the fusing unit 460 or 550 of FIG. 6A is illustrated as a fusing roller, another type of toner fusing unit 620 may be used according to the application of the fusing unit 460 or 550 without departing from the scope of the present invention. Hereinafter, the toner fusing unit 620 will be described for illustrative purposes as a toner fusing roller.

The heating body 660 may be comprised of a coil. Another type of heating body may be used according to the application of the fusing unit 460 or 550 without departing from the scope of the present invention.

The coil of the heating body 660 is resistance-heated by the first induced current generated by the transformer 450 or 530. The first induced current generated by the transformer 450 or 530 is an AC signal which corresponds to the AC signal input to the transformer 450 or 530. When the first induced current of the AC signal is input to the coil of the heating body 660, an alternating magnetic flux that changes according to the first induced current is generated in the coil of the heating body 660. The alternating magnetic flux crosses the fusing roller 620, and an eddy current is generated in the fusing roller 620 to counteract the changes in the alternating magnetic flux. The eddy current generated in the fusing roller 620 will be referred to as a second induced current. The fusing roller 620 may be comprised of a copper alloy, aluminum alloy, nickel alloy, iron alloy, chrome alloy, or magnesium alloy. Accordingly, the fusing roller 620 has an electrical resistance and thus, is resistance-heated by the second induced current. Hereinafter, the heating of the fusing roller 620 using the second induced current will be referred to as induction heating. The fusing roller 620 may be comprised of different materials according to the application of the fusing unit 460 or 550 without departing from the scope of the present invention.

The heating body 660 may be comprised of a copper alloy, aluminum alloy, nickel alloy, iron alloy, or chrome alloy having an end-to-end resistance of the heating body 660 equal to or less than about 100 Ω so that resistance-heating is performed by a resistance loss occurring in the heating body 660 when a current is input to the heating body 660. The heating body 660 may be comprised of different materials according to the application of the fusing unit 460 or 550 without departing from the scope of the present invention.

The insulating layers comprise a first insulating layer 630 interposed between the fusing roller 620 and the heating body 660, and a second insulating layer 640 interposed between the heating body 660 and the tube-expansion adhesion unit 650. The first and second insulating layers 630 and 640 may be comprised of a material selected from the group consisting of mica, polyimide, ceramic, silicon, polyurethane, glass, and polytetrafluoruethylene (PTFE). The insulating layers 630 and 640 may be comprised of different materials according to the application of the fusing unit 460 or 550 without departing from the scope of the present invention.

FIG. 6B is a detailed diagram of a portion B shown in FIG. 6A, that is, the heater 470 or 560 of the fusing unit 460 or 550. The heater 470 or 560 includes the insulating layer 630 interposed between the heating body 660 and the fusing roller 620. The insulting layer 630 prevents the heating body 660 from being shorted to the fusing roller 620, and is comprised of a thin insulating layer inserted between the heating body 660 and the fusing roller 620 in order to prevent electrical shorts. A withstand voltage of the insulating layer 630 may be equal to or less than 1 kV. In order to satisfy the requirement that the withstand voltage be equal to or less than 1 kV, for example, in order to prevent a short between the heating body 660 and the fusing roller 620, a mica sheet having a thickness of about 0.1 mm can be used as the insulating layer 630 of the heater 470 or 560. If it is possible that a mica sheet having a thickness of 0.1 mm will be damaged, two mica sheets such as 630*a* and 630*b* having a thickness of about 0.1 mm each may be used so as to prevent the fusing roller 620 and the heating body 660 from being shorted to each other. In a similar manner, the second insulating layer 640 can include two sheets, such as 640*a* and 640*b*.

As the thickness of the first insulating layer 630 inserted between the fusing roller 620 and the heating body 660 increases, less heat generated by the heating body 660 is transferred to the fusing roller 620. Thus, if the thickness of the first insulating layer 630 is decreased, heat generated by the heating body 660 can be more effectively transferred to the fusing roller 620. The first insulating layer 630 may be formed of different materials and have different thicknesses according to the application of the fusing unit 460 or 550 without departing from the scope of the present invention.

Figure 7:
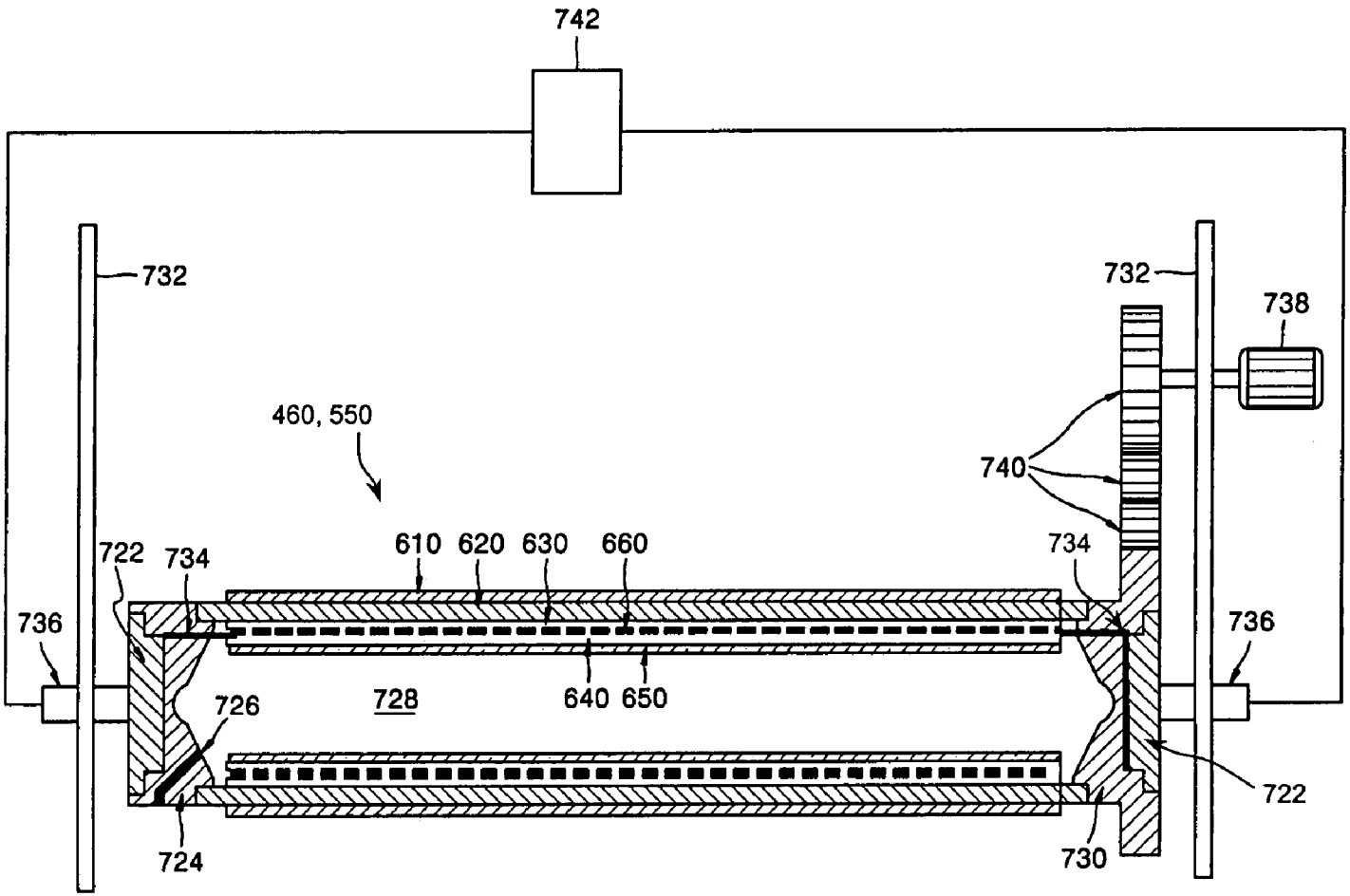
FIG. 7 is a detailed diagram of the fusing unit used in the fusing device of FIG. 4 or 5.

FIG. 7 is a detailed diagram of the fusing unit 460 or 550 used in the fusing device of FIG. 4 or 5. Referring to FIG. 7, the fusing unit 460 or 550 comprises the coating portion 610, the fusing roller 620, the first and second insulating layers 630 and 640, the heating body 660, and the tube-expansion adhesion portion 650. An end cap 724 and a power transmission end cap 730 are installed at opposite ends of the fusing units 460 and 550. The configuration of the power transmission end cap 730 is similar to that of the end cap 724. However, the power transmission end cap 730 is connected to a driving portion 738 installed in a frame 732 for supporting the fusing unit 460 or 550. A power transmission unit, such as a gear train 740, is provided for rotating the fusing unit 460 or 550.

In addition, an air vent 726 is formed in the end cap 724. The air vent 726 is formed in such a manner that after the end cap 724 is installed in the fusing unit 460 or 550, an internal space 728 of the fusing unit 460 or 550 is well ventilated via the air vent 726. Thus, even though the tube-expansion adhesion portion 650 is heated by heat transferred from the heating body 660, the internal space 728 is maintained at an atmospheric pressure via the air vent 726. The air vent 726 may be provided in the power transmission end cap 730. In addition, the air vent 726 may be installed in both the end cap 724 and the power transmission end cap 730.

An electrode 722 is formed in the end cap 724 and the power transmission end cap 730. The electrode 722 is electrically connected to a lead portion 734. A current supplied from an external power supply unit 742 is then supplied to the heating body 660 via a brush 736, the electrode 722, and the lead portion 734.

Figure 8A:
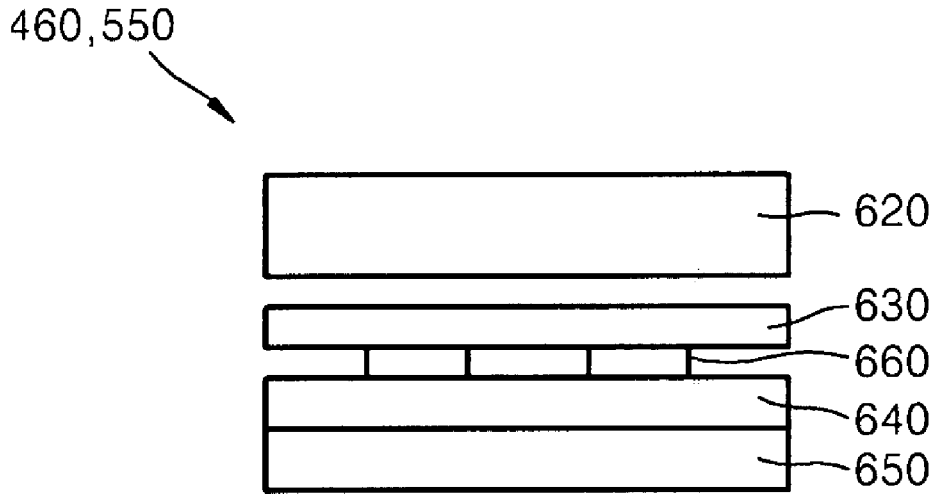
FIGS. 8A and 8B are images to illustrate the state wherein the heater, the fusing roller, and the tube-expansion adhesion portion of the fusing unit used in the fusing device of FIG. 4 or 5, are closely adhered to one another according to an embodiment of the present invention.
Figure 8B:
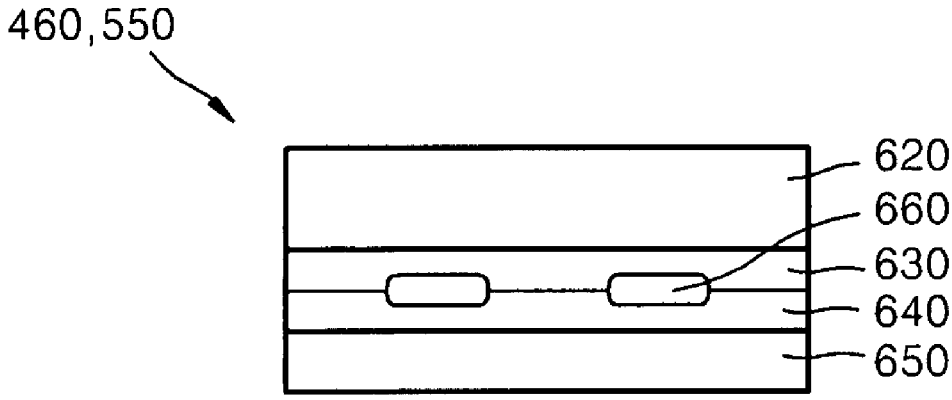

FIGS. 8A and 8B are images to illustrate the state wherein the heaters 470 or 560, the fusing roller 620, and the tube-expansion adhesion portion 650 of the fusing unit 460 or 550 used in the fusing device of FIG. 4 or 5, are closely adhered to one another according to an embodiment of the present invention. In the fusing unit 460 or 550 shown in FIGS. 8A and 8B, a heating coil is illustrated as an example of the heating body 660.

In order to effectively transfer heat generated by the heating coil 660 of the heater 470 or 560 to the fusing roller 620, an air gap should not exist between the first and second insulating layers 630 and 640 of the heater 470 or 560, and the heating coil 660. In an embodiment of the present invention, the heating coil 660 of the fusing unit 460 or 550, and the first and second insulating layers 630 and 640 are plastic-deformed using a tube-expansion pressure applied by the tube-expansion adhesion portion 650, and the plastic-deformed heater 470 or 560 is closely adhered to the fusing roller 620 and the tube-expansion adhesion portion 650. The tube-expansion adhesion portion 650 may be comprised of a non-magnetic material or a pipe. For example, a metallic pipe, coil spring, discharge urethane, or a plastic pipe may be used as the tube-expansion adhesion portion 650.

A preferable tube-expansion pressure applied to the tube-expansion adhesion portion 650 is determined to a degree in which a circumferential tube-expansion pressure of the tube-expansion adhesion portion 650 reaches a yield stress "σ" of a material used for the tube-expansion adhesion portion 650 and which produces permanent plastic deformation. The tube-expansion pressure "P" applied to the tube-expansion adhesion portion 650 is determined using Equation 1 below, $$P = \sigma \frac{t}{r} \quad (1)$$

wherein P is the tube-expansion pressure, σ is a yield stress, t is the thickness of the tube-expansion adhesion portion, and r is the radius of a tube-expansion adhesion portion.

FIG. 8A is an image to illustrate the case where air gaps exist between the fusing roller portion 620 and the insulating layer 630, and between the heating coil 660 and the insulating layers 630 and 640.

FIG. 8B is an image to illustrate the case where no air gaps exist between the fusing roller 620, the heating coil 660, and the insulating layers 630 and 640 according to an embodiment of the present invention. A difference of about 4-5 seconds results when heating the fusing roller 620 of the fusing unit 460 or 550 up to a target fusing temperature depending on whether the illustrated air gaps exist in the heater 470 or 560, that is, depending on how closely the fusing roller 620, the heating coil 660, and the insulating layers 630 and 640 are adhered.

FIG. 9 is a table illustrating experimental data comparing the time required for heating a fusing roller of a fusing unit to a target fusing temperature in both a conventional fusing unit using a halogen lamp as a heat source, and a fusing unit according to an embodiment of the present invention in which the fusing roller 620 and the heater 470 or 560 are closely adhered to one another (hereinafter, an exemplary fusing unit according to an embodiment of the present invention will be referred to as an E-coil fusing unit). In the experiment, mica sheets were used as the first and second insulating layers of the E-coil fusing unit, the radius of the fusing roller was 32 mm, and the fusing roller was comprised of aluminum (Al). Referring to FIG. 9, the experiment shows that it took 75 seconds to heat the fusing roller portion of the conventional fusing unit from a room temperature of 20° C. to a target fusing temperature of 180° C. using a conventional halogen lamp.

In the E-coil fusing unit according to an embodiment of the present invention, when the insulating layers were formed of three and two mica sheets having a thickness of 0.18 mm each, the withstand voltage between the fusing roller 620 and the heating body 660 was 6 kV and 4.2 kV, respectively. In these cases, it took 34 seconds and 24 seconds, respectively, to heat the fusing roller 620 of the E-coil fusing unit from a room temperature of 20° C. to a target fusing temperature of 180° C.

In the E-coil fusing unit according to an embodiment of the present invention, when the insulating layers were formed of three and two mica sheets having a thickness of 0.15 mm each, the withstand voltage between the fusing roller 620 and the heating body 660 was 4.8 kV and 3 kV, respectively. In these cases, it took 27 seconds and 14 seconds, respectively, to heat the fusing roller 620 from a room temperature of 20° C. to a target fusing temperature of 180° C.

When the insulating layers were formed of three, two, and one mica sheets having a thickness of 0.1 mm each, the withstand voltage between the fusing roller 620 and the heating body 660 was 3.3 kV, 2.3 kV, and 1.4 kV, respectively. In these cases, it took 16 seconds, 10 seconds, and 6 seconds, respectively, to heat the fusing roller 620 from a room temperature of 20° C. to a target fusing temperature of 180° C.

Referring to FIG. 9, a warm-up time taken for heating the fusing roller to the target fusing temperature in the fusing unit using the halogen lamp as the heat source is considerably longer than a warm-up time taken for heating the fusing roller to the target fusing temperature in the E-coil fusing unit. As the thickness of the insulating layer in the E-coil fusing unit increases, the time to heat the fusing roller from the room temperature to the target fusing temperature increases.

As described above, in the fusing device according to the present invention, a power supply unit and a heating coil are electrically insulated from each other by a transformer such that only a thin insulating layer is formed for preventing a fusing roller and a heating coil from being shorted to each other. By providing the thin insulating layer, heat generated by the heating coil is effectively transferred to the fusing roller such that the fusing roller can be quickly heated from a room temperature to a target fusing temperature.

In addition, since the fusing roller can be quickly heated from a room temperature to the target fusing temperature, the temperature of the fusing roller need not be kept constant for a predetermined amount of time when a printing operation is not performed, and thus, unnecessary power consumption can be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A heating device for fusing a toner image, the device comprising:

a power supply unit for supplying a first alternating current for generating at least a second alternating current;

an insulation unit for generating a first induced current in response to at least the second alternating current, the insulation unit comprising a primary and a secondary coil, wherein the primary coil is electrically insulated from a heating body of the heating device and is switchably controlled by an alternating current generator electrically coupled to the primary coil, and wherein the secondary coil is electrically coupled to the heating body of the heating device to provide the first induced current to the heating body; and the heating body, configured to be resistance-heated by a second induced current generated in the heating body by the first induced current received from the secondary coil of the insulation unit, and wherein the insulation unit is physically outside the heating body.

2. The device of claim 1, wherein the insulation unit electrically insulates the power supply unit from the heating body.

3. The device of claim 2, wherein the insulation unit is comprised of a transformer.

4. The device of claim 3, wherein the transformer is comprised of a high-frequency transformer.

5. The device of claim 3, wherein the heating body is comprised of conductive material surrounding an electrical coil and configured to be resistance-heated by the second induced current generated in the conductive material of the heating body by the first induced current received from the secondary coil.

6. The device of claim 1, further comprising:

a rectifier for generating a direct current by rectifying the first alternating current; and the alternating-current generator for generating the second alternating current from the direct current and supplying the second alternating current to the insulation unit.

7. The device of claim 6, wherein the alternating-current generator generates a high-frequency alternating current.

8. The device of claim 6, further comprising a line filter for removing harmonic noise components from the first alternating current input to the rectifier.

9. A power supply device for supplying power to a fusing unit for fusing a toner image, the device comprising:

a power supply unit for supplying a first alternating current for generating at least a second alternating current; and an insulation unit for generating a first induced current in response to at least the second alternating current, and supplying the generated first induced current to a heating body of the fusing unit, the insulation unit comprising a primary and a secondary coil, wherein the primary coil is electrically insulated from the heating body of the fusing unit and is switchably controlled by an alternating current generator electrically coupled to the primary coil, and wherein the secondary coil is electrically coupled to the heating body of the fusing unit to provide the first induced current to the heating body, wherein the heating body is configured to be resistance-heated by a second induced current generated in the heating body by the first induced current received from the secondary coil of the insulation unit, and wherein the insulation unit is physically outside the heating body.

10. The device of claim 9, wherein the insulation unit electrically insulates the power supply unit from the fusing unit.

11. The device of claim 10, wherein the insulation unit is comprised of a transformer.

12. The device of claim 11, wherein the transformer is comprised of a high-frequency transformer.

13. The device of claim 9, further comprising:

a rectifier for generating a direct current by rectifying the first alternating current; and the alternating-current generator for generating the second alternating current from the direct current and supplying the second alternating current to the insulation unit.

14. The device of claim 13, wherein the alternating-current generator generates a high-frequency alternating current.

15. The device of claim 13, further comprising a line filter for removing harmonic noise components from the first alternating current input to the rectifier.

16. A unit for fusing a toner image, the unit comprising:

an insulation unit for generating a first induced current, the insulation unit comprising a primary and a secondary coil, wherein the primary coil is electrically insulated from both a toner fusing unit and a heater of the toner fusing unit, and is switchably controlled by an alternating current generator electrically coupled to the primary coil, and wherein the secondary coil is electrically coupled to the heater of the toner fusing unit to provide the first induced current to the heater;

the heater, comprising a heating coil which is configured to be resistance-heated when input with the first induced current from the secondary coil of the insulation unit, and a first insulating layer interposed between the heating coil and a fusing layer of the toner fusing unit, wherein a withstand voltage of the first insulating layer is equal to or less than 1 kV, wherein the fusing layer is configured to be resistance-heated by a second induced current generated in the fusing layer by the first induced current received from the secondary coil of the insulation unit, and wherein the insulation unit is physically outside the heater; and the fusing layer of the toner fusing unit comprised of a roller which fuses the toner image.

17. The unit of claim 16, wherein the first insulating layer is comprised of at least one material selected from the group consisting of mica, polyimide, ceramic, silicon, polyurethane, glass, and polytetrafluoruethylene (PTFE).

18. The unit of claim 17, wherein the first insulating layer is comprised of mica with a thickness equal to or less than about 0.2 mm.

19. The unit of claim 16, wherein the heater is closely adhered to the fusing layer of the toner fusing unit.

20. The unit of claim 19, further comprising an adhesion portion disposed inside the toner fusing unit and closely adhering the heater to the fusing layer of the toner fusing unit.

21. The unit of claim 20, wherein the adhesion portion is comprised of a tube-expansion adhesion portion for closely adhering the heater to the fusing layer of the toner fusing unit using a predetermined tube-expansion pressure.

22. The unit of claim 20, further comprising a second insulating layer interposed between the adhesion portion and the heater.

23. A unit for fusing a toner image, the unit comprising:

an insulation unit for generating a first induced current, the insulation unit comprising a primary and a secondary coil, wherein the primary coil is electrically insulated from both a fusing roller and a heater of the fusing roller, and is switchably controlled by an alternating current generator electrically coupled to the primary coil, and wherein the secondary coil is electrically coupled to the heater of the fusing roller to provide the first induced current to the heater;

the heater, comprising a heating coil which is configured to be resistance-heated when input with the first induced current from the secondary coil of the insulation unit, and a first insulating layer interposed between the heating coil and the fusing roller, wherein a withstand voltage of the first insulating layer is equal to or less than 1 kV, wherein the fusing roller is configured to be resistance-heated by a second induced current generated in the fusing roller by the first induced current received from the secondary coil of the insulation unit, and wherein the insulation unit is physically outside the heater; and the fusing roller which fuses the toner image using the heat received from the heater.

24. The unit of claim 23, wherein the first insulating layer is comprised of at least one material selected from the group consisting of mica, polyimide, ceramic, silicon, polyurethane, glass, and polytetrafluoruethylene (PTFE).

25. The unit of claim 24, wherein the first insulating layer is comprised of mica with a thickness equal to or less than about 0.2 mm.

26. The unit of claim 23, wherein the heater is closely adhered to the fusing roller.

27. The unit of claim 26, wherein the heater is rotated together with the fusing roller.

28. The unit of claim 26, further comprising an adhesion portion disposed inside the fusing roller and closely adhering the heater to the fusing roller.

29. The unit of claim 28, wherein the adhesion portion is comprised of a tube-expansion adhesion portion for closely adhering the heater to the fusing roller using a predetermined tube-expansion pressure.

30. The unit of claim 28, wherein the heater is rotated together with the fusing roller and the adhesion portion.

31. The unit of claim 28, further comprising a second insulating layer interposed between the adhesion portion and the heater.

32. A device for fusing a toner image, the device comprising:

a power supply unit which generates a first induced current in response to an alternating current, the power supply unit comprising a primary and a secondary coil, wherein the primary coil is electrically insulated from a heater of a fusing unit of the device and is switchably controlled by an alternating current generator electrically coupled to the primary coil, and wherein the secondary coil is electrically coupled to the heater of the fusing unit to provide the first induced current to the heater; and the heater of the fusing unit, configured to be both resistance-heated and induction-heated by a second induced current generated in the heater by the first induced current received from the secondary coil of the power supply unit and fusing the toner image using the generated heat, and wherein the power supply unit is physically outside the heater.

33. The device of claim 32, wherein the power supply unit comprises:

a power unit for supplying a first alternating current;

a rectifier for generating a direct current from the first alternating current;

the alternating-current generator for generating a second alternating current from the direct current; and an insulation unit comprising at least the primary and secondary coil for generating the first induced current in response to the second alternating current and supplying the first induced current to the fusing unit.

34. The device of claim 33, wherein the insulation unit electrically insulates the alternating-current generator from the fusing unit.

35. The device of claim 34, wherein the insulation unit is comprised of a transformer.

36. The device of claim 32, wherein the fusing unit comprises:

the heater which is resistance-heated by the first induced current, and for generating an alternating magnetic flux that changes according to the first induced current; and a fusing layer of the toner fusing unit for generating the second induced current from the alternating magnetic flux and which is resistance-heated by the second induced current.

37. The device of claim 36, wherein the heater comprises:

a heater coil which is resistance-heated by the first induced current, and for generating the alternating magnetic flux that changes according to the first induced current; and an insulating layer interposed between the heater coil and the fusing layer of the toner fusing unit.

38. The device of claim 37, wherein a withstand voltage of the insulating layer is equal to or less than 1 kV.

39. The device of claim 37, further comprising an adhesion portion disposed inside the toner fusing unit and closely adhering the heater to the fusing layer of the toner fusing unit.

40. The device of claim 39, wherein the fusing layer of the toner fusing unit is comprised of a fusing roller and wherein the heater is rotated together with the fusing roller and the adhesion portion.

* * * * *